United States Patent [19]

Maekawa et al.

[11] Patent Number: 5,070,008

[45] Date of Patent: Dec. 3, 1991

[54] LIGHT-SENSITIVE SILVER HALIDE PHOTOGRAPHIC MATERIAL

[75] Inventors: Hideaki Maekawa; Masanobu Miyoshi, both of Odawara, Japan

[73] Assignee: Konica Corporation, Tokyo, Japan

[21] Appl. No.: 614,019

[22] Filed: Nov. 14, 1990

Related U.S. Application Data

[63] Continuation of Ser. No. 300,478, Jan. 23, 1989, abandoned.

[30] Foreign Application Priority Data

Jan. 30, 1988 [JP] Japan ..... 63-20365

[51] Int. Cl.[5] ..... G03C 1/02

[52] U.S. Cl. ..... 430/567; 430/564; 430/569; 430/605; 430/621; 430/623

[58] Field of Search ..... 430/564, 621, 623, 567, 430/569, 605

[56] References Cited

U.S. PATENT DOCUMENTS

| | | | |
|---|---|---|---|
| 4,820,624 | 4/1989 | Hasebe et al. | 430/567 |
| 4,837,143 | 6/1989 | Komorita et al. | 430/621 |
| 4,912,017 | 3/1990 | Takagi et al. | 430/567 |
| 4,912,026 | 3/1990 | Miyoshi | 430/621 |
| 4,963,466 | 10/1990 | Kajiwara et al. | 430/567 |
| 5,015,563 | 5/1991 | Ohya et al. | 430/567 |

*Primary Examiner*—Charles L. Bowers, Jr.
*Assistant Examiner*—Thomas R. Neville
*Attorney, Agent, or Firm*—Jordan B. Bierman

[57] ABSTRACT

A light-sensitive silver halide photographic material which comprises a support and provided thereon a silver halide emulsion layer containing silver halide grains of which silver chloride content is not less than 90 mol %, and which have been formed in the presence of an iridium compound and a nitrogen containing heterocyclic compound, and under acidic condition is disclosed.

9 Claims, No Drawings

LIGHT-SENSITIVE SILVER HALIDE PHOTOGRAPHIC MATERIAL

This application is a continuation of application Ser. No. 07/300,478, filed Jan. 23, 1989, now abandoned.

FIELD OF THE INVENTION

The present invention relates to a light-sensitive silver halide photographic material.

BACKGROUND OF THE INVENTION

In methods of forming a dye image by using a light-sensitive silver halide color photographic material, the dye image is usually formed by reacting, after image-wise exposure, an oxidized p-phenylenediamine color developing agent with a dye image forming coupler. In such methods, color reproduction is commonly carried out by applying the subtractive color process, where cyan, magenta and yellow dye images corresponding to red, green and blue are formed in respectively corresponding light-sensitive layers. In recent years, in forming such dye images, it has become common to carry out development processing at higher temperatures and lessen certain processing steps, in order to shorten the steps for development processing. In particular, in order to shorten the development processing time by carrying out the development processing at high temperatures, it is very important to increase the developing speed in color developing. The developing speed in color developing is influenced from two directions. One of them is light-sensitive silver halide color photographic materials and the other of them is color developing solutions.

In the former, particularly the shape, size and composition of the grains of light-sensitive silver halide emulsions used may greatly influence the developing speed. In the latter, conditions of color developing solutions, in particular, types of development restrainers tend to influence the developing speed. In particular, silver chloride grains are known to exhibit a remarkably high developing speed under specific conditions.

For this reason, light-sensitive silver halide color photographic materials having silver halide emulsion layers containing silver halide grains substantially consisting of silver chloride (hereinafter "light-sensitive silver chloride color photographic materials"), which can achieve much faster processing than the conventional light-sensitive materials that employ silver chlorobromide, are greatly advantageous for carrying out the processing in a short time, minimizing automatic processors, reducing development replenishing solutions, and further decreasing the burden to environmental pollution when used in miniature photofinishing laboratories which have been recently highlighted. Accordingly various studies have been made to put them into practical use, as having been demonstrated in all sorts of publications, patents and so forth.

However, the light-sensitive silver halide color photographic materials containing silver halide grains substantially consisting of silver chloride were found to cause a great variation in speed (sensitivity) or gradation depending on exposure illuminance, as compared with light-sensitive color photographic materials containing silver halide grains having other composition.

It is a hitherto well-known phenomenon that the speed changes as the illuminance varies, even under the same amount of exposure. Hence, countermeasures have been taken such that the amount of exposure is varied corresponding to a previously estimated change in speed, thus bringing about no particular serious obstacles from a practical viewpoint.

Nonetheless, in instances in which the variation of gradation by exposure illuminance (hereinafter called "illuminance dependence of gradation") is large, the change turns to a fatal defect from the view point of the quality of light-sensitive materials. The light-sensitive materials differ in their desired gradation depending on what they are used for, and they are designed to give a correspondingly different gradation. When these light-sensitive materials are actually exposed to light, the exposure illuminance changes as a matter of course depending on exposure conditions as exemplified by the lightness of an object in the case of light-sensitive materials used in taking photographs, or the difference in image density due to over- or under-exposure of original image films in the case of light-sensitive materials used in printing. In the case of light-sensitive material having a large illuminance dependence of gradation, the gradation actually obtained may deviate from the tolerance range of the designed target gradation, depending on the degree of exposure illuminance.

This may result in an excessively high contrast depending on scenes to give no representation particularly at low-density portions and high-density portions, or, on the contrary, an excessively soft contrast to give no sharpness with a feeling of an out-of-tone, bringing about a serious loss of the quality as light-sensitive material in both cases.

Moreover, in the case of the light-sensitive materials used in printing, they have a variety of print size, including, among those commonly used, the small-sized ones of so-called E-size and even those of the full-length size. Usually users often try first printing out a film of several scenes, select preferred scenes from among them, and enlarge them to a larger size. In this occasion, the original image film used in the printing to a small size is the same as in the printing to a large size and also it is difficult to steeply increase the intensity of a light source, so that making enlargement to a large-sized print may inevitably result in a lowering of the exposure illuminance on the printing light-sensitive materials. As a result, when the illuminance dependence of gradation is large, the image quality is worsened in large-sized prints even though a preferable image quality can be obtained in small-sized prints, thus making it unable to satisfy the users.

An improvement in exposure apparatus has brought the change in speed depending on exposure illuminance to cause no particular serious problems as previously mentioned above, but it is very difficult to cope with the change in gradation by improving equipments such as exposure apparatus. Accordingly, an improvement in the illuminance dependence of gradation is sought from the direction of light-sensitive materials.

As techniques for improving such illuminance dependence, a technique to improve it by using iridium compounds has already been disclosed, for example, in Japanese Patent Publications Open to Public Inspection [hereinafter referred to as Japanese Patent O.P.I. Publication(s)], No. 97648/1986, No. 93448/1986 and No. 3536642/1986. The present inventors, however, have ever made studies on these techniques to find that in respect of silver halide emulsions "substantially" consisting of "silver chloride", the illuminance dependence is less improved by using iridium compounds, than in respect of those comprising silver chlorobromide having a silver chloride content of 90 mol % or less, silver bromide, silver iodobromide or the like. They further have found that the resistance to pressure is deteriorated because of the use of iridium compounds in the case of silver halide emulsions substantially consisting of silver chloride. An improvement in the pressure resistance by the use of iridium compounds is disclosed in Japanene Patent O.P.I. Publication No. 51733/1981, but it was quite unexpected that the pressure resistance is deteriorated on the contrary. As a result of studies, this also was found to be presumably inherent in the silver halide emulsions containing silver chloride in a large amount, but the deterioration of pressure resistance is even fatal as manufactures.

Namely, this is because, with achievement of rapid processing and spread of miniature photofinishing laboratories, light-sensitive materials tend to be applied with pressure and stress in a stronger and more various manner, and are thus required to have resistance also to the pressure.

A number of reports have been made on researches relating to the fact that this physical pressure causes fog or desensitization in silver halide emulsions that constitute the light-sensitive materials.

For example, D. Dautrich, F. Granzer and E. Moisar, The Journal of Photographic Science, Vol. 21 (1973), p. 221–226, makes a detailed report on the deformation of silver halide grains owing to pressure, the strain or lattice defects in crystals under such a state, and the influence which these may give to the distribution of latent image centers.

As a means for improvement to cope with this pressure fog or pressure desensitization, hitherto known is a method by which the pressure is made not to reach silver halide grains, i.e., a method in which various gelatins, polymer, surfactants or other various organic matters are used in a protective layer or intermediate layer of light-sensitive materials and a layer containing silver halide grains.

For example, methods are known in which used are heterocyclic compounds, as in British Patent No. 738,618, alkylphthalates, as in British Patent No. 738,637, alkyl esters, as in British Patent No. 738,639, hydrophilic compounds, in particular, polyhydric alcohols, as in U.S. Pat. No. 2,960,404, carboxyalkyl celluloses, as in U.S. Pat. No. 3,121,060, paraffins and carboxylic acid slats, as in Japanese Patent O.P.I. Publication No. 5017/1974, glycerol derivatives and ether or thioether compounds, as in Japanese Patent O.P.I. Publication No. 141623/1976, organic high-boiling compounds not miscible with hydrophilic binders, as in Japanese Patent O.P.I. Publication No. 85421/1978, and alkyl acrylates and organic acids, as in Japanese Patent Examined Publication No. 28086/1978, respectively.

However, the present state of things is that these passive methods are almost ineffective to a strong pressure against light-sensitive materials, and may rather result in an excessive stickiness given on the surfaces of light-sensitive materials or bring about an adverse influence such as sensitization, desensitization, change of gradation or fog against the performances of light-sensitive materials, thus not sufficiently achieving what is originally aimed therein.

Thus, the present inventors were urged to make compatible the illuminance dependence and pressure resistance, and made studies on various additives. In the course of the studies, the effect to improve pressure resistance was found to be obtainable by using a mercapto compound having the product of solubility ($K_{PS}$) to silver ions, of $10^{-12}$ or less, among nitrogen-containing heterocyclic compounds used as growth modifiers or stabilizers during the formation of grains. Since, however, the effect was still insufficient, they intensively made further studies to find that the pressure resistance can be remarkably improved by forming the grains under an acidic condition. This was found to be effective also to the illuminance dependence.

SUMMARY OF THE INVENTION

Accordingly, an object of the present invention is to provide as a light-sensitive material employing a silver halide emulsion substantially consisting of silver chloride, a light-sensitive material that can have no or very small illuminance dependence of gradation and may suffer very little generation of fog or lowering of density owing to pressure.

To achieve the above object, the present inventors made intensive studies, and found that the above object can be achieved by a light-sensitive material that employs a silver halide emulsion substantially consisting of silver chloride, said emulsion being prepared by;

carrying out the step of forming silver halide grains, in an acidic condition; and carrying out part or all of the step of forming the grains, in the presence of water-soluble iridium compound and also in the presence of a nitro-containing heterocyclic compound.

DETAILED DESCRIPTION OF THE INVENTION

In the silver halide photographic light-sensitive material of the present invention, the silver halide grains contained in at least one layer of the silver halide emulsion layers comprise chloride-rich silver halide grains having a silver chloride content of not less than 90 mol %. For the effect of the present invention, the silver halide content may preferably range from 99.0 mol % to 99.9 mol %, thus simultaneously satisfying the effect of the present invention and the rapid-processing performance.

The silver halide grains according to the present invention may be any of silver chlorobromide, silver iodochloride, silver chloroiodobromide and silver chloride. Silver iodide may be contained, but preferably in an amount of 1 mol % or less, and more preferably 0.5 mol % or less. Most preferably, no silver iodide may be contained at all. Thus, the silver halide grains most preferred for the present invention comprise silver chlorobromide and silver chloride, but most preferred grains comprise silver chlorobromide having the above silver chloride content.

The silver halide grains according to the present invention may be mixed with silver halide grains outside the present invention, but, in such an instance, the proportion of the projected area held by the silver halide grains of the present invention to the projected area held by the whole silver halide grains in the silver halide emulsion layer containing the silver halide grains according to the present invention may preferably be 50% or more, and more preferably 75% or more.

The silver halide grains of the present invention can be formed following the procedures described, for example, in Japanese Patent O.P.I. Publications No. 162540/1984, No. 48755/1984, No. 222844/1985, No. 222845/1985 and No. 136735/1985.

There are no particular limitations on the grain size of the silver halide grains according to the present invention, but, taking account of the rapid processing performance and speed, and also other photographic performances, it may be preferably in the range of from 0.2 to 1.6 μm, and more preferably from 0.25 to 1.2 μm. The above grain size can be measured by all sorts of methods generally employed in the present technical field. Typical methods are described in Loveland, "Grain Size Analytical Methods", A.S.T.M. Symposium on Light Microscopy, 1955, pp. 94–122, or Mees and James, "The Theory of The Photographic Process", 3rd Ed., 2nd Chapter, Macmillan Publishing Co., Inc. (1966). This grain size can be measured by use of the projected area or diameter approximate value of a grain. If the grains are of substantially uniform shape, the grain size distribution can be represented considerably accurately as the diameter or projected area.

The grain size distribution of the silver halide grains according to the present invention may be polydisperse or monodisperse. Preferred are monodisperse silver halide grains wherein, in the grain size distribution of the silver halide grains, its variation coefficient is 0.22 or less, and preferably 0.15 or less. Here, the variation coefficient is a coefficient indicating the breadth of the grain size distribution, and can be defined by the following formula:

$$\text{Variation coefficient } (S/\bar{r}) = \frac{\text{Standard deviation of grain size distribution}}{\text{Average grain size}}$$

$$\text{Standard deviation } (S) \text{ of grain size distribution} = \sqrt{\frac{\Sigma(r - \bar{r})^2 ni}{\Sigma ni}}$$

$$\text{Average grain size } (\bar{r}) = \frac{\Sigma niri}{\Sigma ni}$$

Here, ri represents the grain size of the respective grains; and ni, its number. The grain size herein mentioned indicates the diameter when a silver halide grain is spherical; and, when it is cubic or of the form other than the spherical, the diameter obtained by calculating a projected image thereof as a round image having the same area.

The silver halide grains according to the present invention are formed in the presence of an acidic condition. The acidic condition herein mentioned means that the pH is less than 7, preferably 5 or less, and more preferably 4 or less.

The manner in which the pH is adjusted may follow any desired methods, but there may preferably be used inorganic acids such as sulfuric acid, hydrochloric acid and nitric acid, and organic acids such as acetic acid and citric acid.

The manner in which soluble silver salts are reacted with readily soluble halogen salts may be any of those including the regular mixing method, the reverse mixing method, the simultaneous mixing method, and the combination of any of these, but preferred are grains obtained by the simultaneous mixing method. As one manner of the simultaneous mixing method, there can be further used the pAg-controlled double jet method described in Japanese Patent O.P.I. Publication No. 48521/1979.

As the silver halide grains according to the present invention, those of any shape can be used. A preferable example thereof is a cube having {100} face as a crystal surface. It is also possible to prepare grains of the shape such as an octahedron, a tetradecahedron or a dodecahedron according to the methods as disclosed in publications such as U.S. Pat. Nos. 4,183,756 and 4,225,666, Japanese Patent O.P.I. Publication No. 26589/1980, Japanese Patent Publication No. 42737/1980, and The Journal of Photographic Science, 21, 39 (1973), and put them into use. There may be further used grains having twin-crystal face of grains having irregular shapes.

In the present invention, the silver halide grains are formed in the presence of a water-soluble iridium compound. This means that an iridium compound is added at any stages of the formation of nuclei of silver halide, crystal growth, and physical ripening. A specific method therefor include a method in which the iridium compound is previously added in a mother solution before the formation of nuclei, or a method in which it is added with a rush in the course of the growth of silver halide grains, or a method in which it is added after completion of the growth and immediately before the physical ripening is carried out. Alternatively, the iridium compound may also be added in the manner divided into different stages. The iridium compound to be added may be used in the form of a solution obtained by mixing two or more different kinds of iridium compounds. Alternatively, two or more solutions each comprising a different kind of iridium compound may be added at different stages.

In the present invention, the iridium compound may preferably be added in an amount of from $10^{-9}$ to $10^{-4}$ mol, and more preferably from $10^{-8}$ to $10^{-5}$ mol, in the number of mols of the iridium compound per mol of silver halide. The amount otherwise less than the above may result in no sufficient exhibition of the effect of the present invention, and an excessive amount may cause generation of fog, undesirably.

There are no particular limitations on the iridium compound used in the present invention, but the compound that is usable and preferable from the viewpoint of the stability, safety or economical merits of the compound includes halogenated iridium (III) compounds, halogenated iridium (IV) compounds, and those having a halogen, amine, oxalato or the like as a ligand in a iridium complex. Examples thereof are shown below, but the present invention is by no means limited to these: Iridium trichloride, iridium tribromide, potassium hexachloroiridatae (III), ammonium iridium (III) sulfate, potassium iridium (III) disulfate, tripotassium iridium (III) trisulfate, iridium (III) sulfate, trioxalatoiridium (III), iridium tetrachloride, iridium tetrabromide, potassium hexachloroiridate (IV), ammonium hexachloroiridate (IV), potassium iridate (IV), trioxalatoiridium (IV).

In the present invention, any desired compounds can be selected from these compounds, or optionally can be used in combination. These iridium compounds are used by dissolving in water or a solvent miscible with water, but a method frequently practiced for the purpose of stabilizing a solution of the iridium compound can be used, i.e. a method in which a hydrogen halide as exemplified by hydrochloric acid or oxalic acid or an alkali halide as exemplified by potassium chloride, sodium chloride or potassium bromide is added.

The emulsion of the present invention may be either an emulsion from which unnecessary soluble salts are removed after completion of the growth of silver halide grains, or an emulsion in which they remain unremoved.

In the present invention, the silver halide emulsion containing the above silver halide grains according to the present invention comprises at least one nitrogen-containing heterocyclic compound which is added at any time between before the commencement of the formation of silver halide grains and on or before the commencement of chemical sensitization.

The nitrogen-containing heterocyclic compound used in the present invention, represented by Formula (S), may be of any type, but may preferably be a mercapto compound having the physical property that the product of solubility ($K_{SP}$) to silver ions is $1\times10_{-12}$ or less, which can more strongly exhibit the effect of the present invention. The solubility product can be measured and calculated by making reference on "Shin-Jikken Kagaku Koza (New Experimental Chemistry Course), Vol. 1" (pp. 233–250, published by Maruzen).

In the present invention, the nitrogen-containing heterocyclic compound having the above physical property that the product of solubility to silver ions is $1\times10^{-12}$ or less may preferably include those having $K_{SP}$ of $1\times10^{-12}$ or less among the compound represented by Formula (S) shown below.

Formula (S):

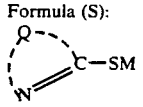

wherein Q represents a group of atoms necessary to complete a 5- or 6-membered heterocyclic ring or a 5- or 6-membered heterocyclic ring condensed with a benzene ring; and M represents a hydrogen atom or a cation.

The mercapto compound represented by Formula (S) preferably used as the organic compound of the present invention will be described below.

In Formula (S), in which Q represents a group of atoms necessary to complete a 5- or 6-membered heterocyclic ring or a 5- or 6-membered heterocyclic ring condensed with a benzene ring, the heterocyclic ring represented by Q may include, for example, an imidazole ring, a tetrazole ring, a thiazole ring, an oxazole ring, a selenazole ring, a benzimidazole ring, a naphthoimidazole ring, a benzothiazole ring, a naphthothiazole ring, a benzoselenazole ring, a naphthoselenazole ring and a benzoxazole ring.

The cation represented by M may include, for example, alkali metals (for example, sodium and potassium) and an ammonium salt.

The mercapto compound represented by Formula (S) may preferably be the compounds represented respectively by Formulas (SA), (SB), (SC) and (SD) shown below.

Formula (SA):

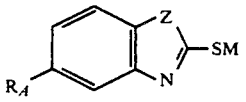

In the formula, $R_A$ represents a hydrogen atom, an alkyl group, an alkoxy group, an aryl group, a halogen atom, a carboxyl group or a salt thereof, a sulfo group or a salt thereof, or an amino group; Z represents a group of —NH—, —O— or —S—; and M has the same definition as M in Formula (S).

Formula (SB):

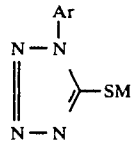

In the formula, Ar represents a group of;

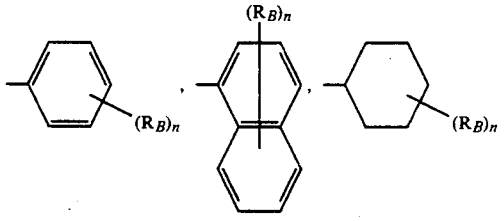

$R_B$ represents an alkyl group, an alkoxy group, a carboxyl group or a salt thereof, a sulfo group or a salt thereof, a hydroxyl group, an amino group, an acylamino group, a carbamoyl group, or a sulfonamide; n represents an integer of 0 to 2; and M has the same definition as M in Formula (S).

In Formulas (SA) and (SB), the alkyl group represented by $R_A$ and $R_B$ may include, for example, a methyl group, an ethyl group, and a butyl group; the alkoxy group may include, for example, a methoxy group and an ethoxy group; and the salt of the carboxyl group or sulfo group may include, for example, a sodium salt and an ammonium salt.

In Formula (SA), the aryl group represented by $R_A$ may include, for example, a phenyl group, and a naphthyl group; and the halogen atom may include, for example, a chlorine atom, and a bromine atom.

In Formula (SB), the acylamino group represented by $R_B$ may include, for example, a methylcarbonylamino group, and a benzoylamino group; the carbamoyl group may include, for example, an ethylcarbamoyl group, and a phenyl carbamoyl group; and the sulfonamide group may include, for example, a methylsulfonamide group, and a phenylsulfonamide.

The above alkyl group, alkoxy group, aryl group, amino group, acylamino group, carbamoyl group, sulfonamide group, etc. also include those further having a substituent.

Formula (SC):

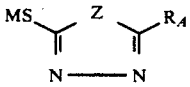

In the formula, Z represents

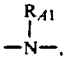

an oxygen atom or a sulfur atom. $R_A$ represents a hydrogen atom, an alkyl group, an aryl group, an alkenyl group, a cycloalkyl group, $—SR_{A1}$,

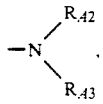

—NHCOR$_{A4}$, —NHSO$_2$R$_{A5}$, or a heterocyclic ring, wherein R$_{A1}$ represents a hydrogen atom, an alkyl group, an alkenyl group, a cycloalkyl group, an aryl group, —COR$_{A4}$ or SO$_2$R$_{A5}$; R$_{A2}$ and R$_{A3}$ each represent a hydrogen atom, an alkyl group or an aryl group; and R$_{A4}$ and R$_{A5}$ each represent an alkyl group or an aryl group. M has the same definition as M is Formula (S).

The alkyl group represented by R$_A$, R$_{A1}$, R$_{A2}$, R$_{A3}$, R$_{A4}$ and R$_{A5}$ in Formula (SC) may include, for example, a methyl group, a benzyl group, an ethyl group, and a propyl group; and the aryl group, a phenyl group, and a naphthyl group.

The alkenyl group represented by R$_A$ and R$_{A1}$ may include, for example, a propenyl group; and the cycloalkyl group, for example, a cyclohexyl group. The heterocyclic group represented by R$_A$ also may include, for example, a furyl group, and a pyridinyl group.

The above alkyl group and aryl group represented by R$_A$, R$_{A1}$, R$_{A2}$, R$_{A3}$, R$_{A4}$ and R$_{A5}$, the alkenyl group and cycloalkyl group represented by R$_A$ and R$_{A1}$, and the heterocyclic ring represented by R$_A$, further include those having a substituent.

Formula (SD):

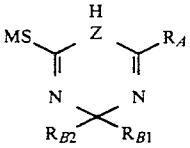

In the formula, R$_A$ and M each have the same definition as R$_A$ and M in Formula (SC). R$_{B1}$ and R$_{B2}$ each represent a group having the same definition as R$_{A1}$ and R$_{A2}$ in Formula (SC).

Examples of the nitrogen containing compounds are shown below, but the present invention is by no means limited by these.

S-1

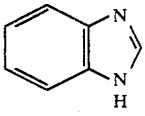

S-2

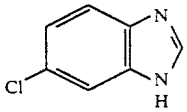

S-3

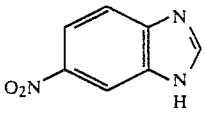

S-4

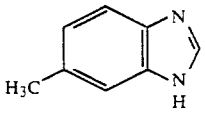

S-5

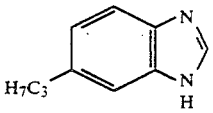

S-6

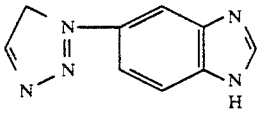

S-7

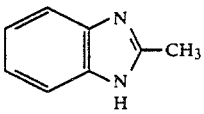

S-8

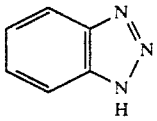

S-9

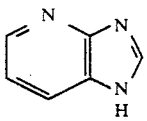

S-10

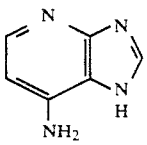

S-11

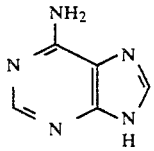

S-12

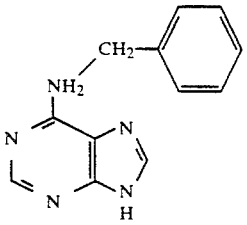

-continued
S-13
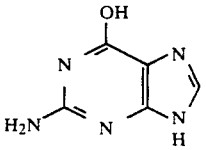
S-14
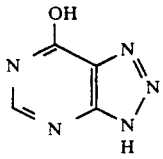
S-15
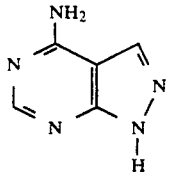
S-16
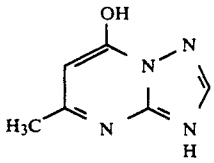
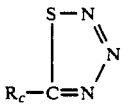
| Compound No. | $R_c$ |
|---|---|
| S-17 | $-NH_2$ |
| S-18 | 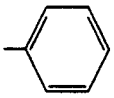 |
| S-19 | 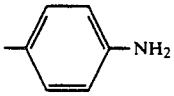 |
| S-20 | $-NO_2$ |
| S-21 | 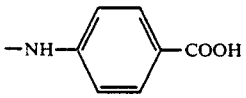 |
| S-22 | 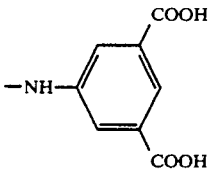 |
| S-23 | 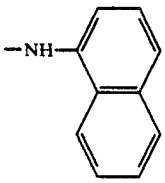 |
| S-24 | 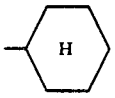 |
| S-25 | 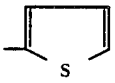 |
| S-26 | 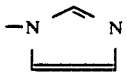 |

-continued
| | | | |
|---|---|---|---|
| S-27 | 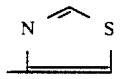 | | |
| S-28 | 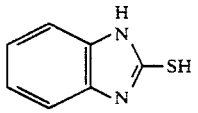 | S-29 | 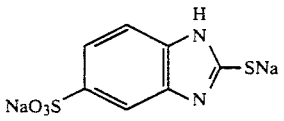 |
| S-30 | 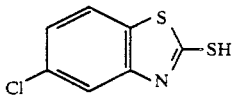 | S-31 | 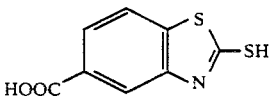 |
| S-32 | 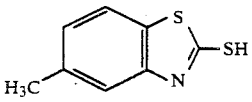 | S-33 | 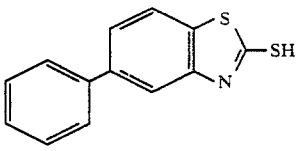 |
| S-34 | 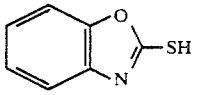 | S-35 | 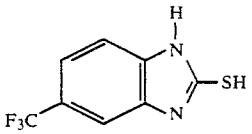 |
| S-36 | 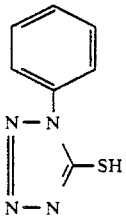 | S-37 | 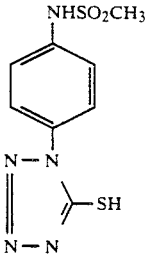 |
| S-40 | 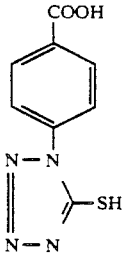 | S-41 | 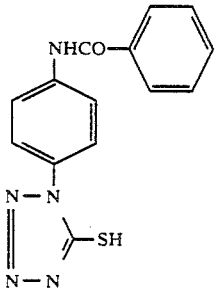 |
| S-42 | 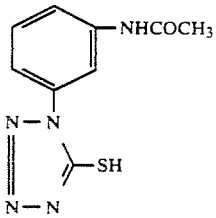 | S-43 | 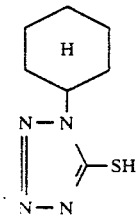 |
| S-44 | 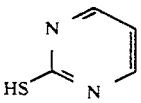 | S-45 | 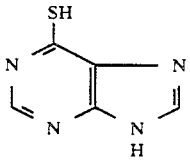 |

-continued
S-46
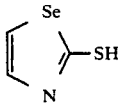
S-47
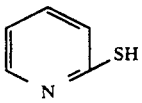
S-48
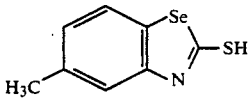
| Compound | $R_A$ | M |
|---|---|---|
| | 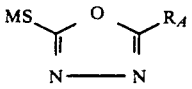 | |
| S-49 | $-C_2H_5$ | $-H$ |
| S-50 | $-CH_2-CH=CH_2$ | $-H$ |
| S-51 | $-CH=CH-CH_2CH_3$ | $-H$ |
| S-52 | $-C_7H_{15}$ | $-H$ |
| S-53 | $-C_9H_{19}$ | $-Na$ |
| S-54 | 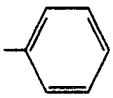 | $-H$ |
| S-55 | $-C_4H_9(t)$ | $-H$ |
| | 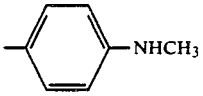 | $-H$ |
| S-57 | 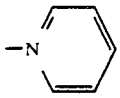 | $-H$ |
| S-58 | 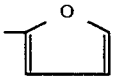 | $-H$ |
| S-59 | 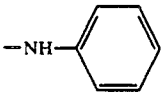 | $-NH_4$ |
| S-60 | 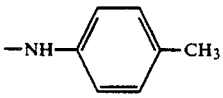 | $-H$ |
| S-61 | $-HNCOCH_3$ | $-H$ |
| S-62 | 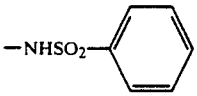 | $-H$ |
| S-63 | $-N(CH_3)_2$ | $-H$ |
| S-64 | 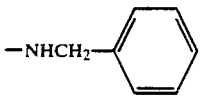 | $-H$ |
| S-65 | 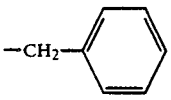 | $-H$ |

-continued
| | | |
|---|---|---|
| S-66 | $-S-CH_3$ | $-H$ |
| S-67 | 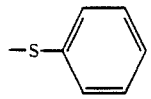 | $-H$ |
| S-68 | $-SH$ | $-H$ |
| | 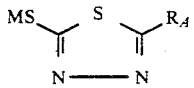 | |
| S-69 | $-H$ | $-H$ |
| S-70 | $-C_2H_5$ | $-H$ |
| S-71 | $-C_4H_9(t)$ | $-H$ |
| S-72 | $-C_6H_{13}$ | $-H$ |
| S-73 | 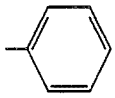 | $-H$ |
| S-74 | 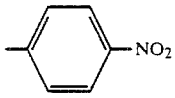 | $-H$ |
| S-75 | 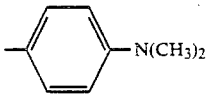 | $-H$ |
| S-76 | 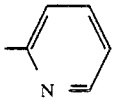 | $-H$ |
| S-77 | 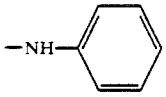 | $-H$ |
| S-78 | $-N(CH_3)_2$ | $-H$ |
| S-79 | $-CH_2CH=CH_2$ | $-H$ |
| S-80 | $-SH$ | $-H$ |
| S-81 | $-NHCOC_2H_5$ | $-H$ |
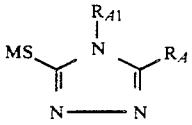
| Compound | $R_A$ | $R_{A1}$ | M |
|---|---|---|---|
| S-82 | $-C_2H_5$ | $-H$ | H |
| S-83 | $-CH_3$ | $-CH_3$ | H |
| S-84 | $-CH_3$ | 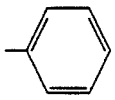 | H |
| S-85 | $-NHCOCH_3$ | $-CH_3$ | H |
| S-86 | 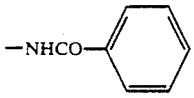 | 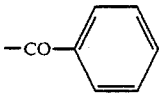 | H |
| S-87 | $-NHCOCH_3$ | $-CO-CH_3$ | H |

-continued
| | | | |
|---|---|---|---|
| S-88 | $-NHCOCH_3$ | $-CH_2-$ 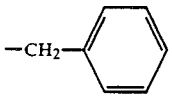 | H |
| S-89 | $-NHCOC_2H_5$ | 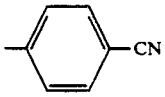 | Na |
| S-90 | $-NHCO-$ 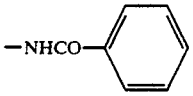 | 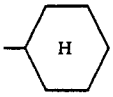 | H |
| S-91 | $-NHSO_2CH_3$ | $-H$ | H |
| S-92 | $-NHCO-$ 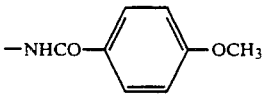 | $-CH_3$ | Na |
| S-93 | $-NHCO-$ 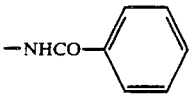 | $-CH_2CH{=}CH_2$ | H |
| S-94 | $-NHCO-$ 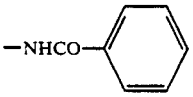 | $-CH_2CH_2O-$ 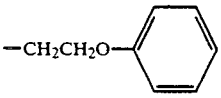 | H |
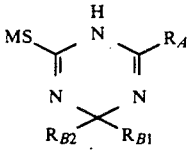
| Compound | $R_A$ | $R_{B1}$ | $R_{B2}$ | M |
|---|---|---|---|---|
| S-95 | $-C_2H_5$ | $-CH_3$ | $-CH_3$ | $-H$ |
| S-96 | 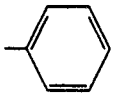 | $-CH_3$ | $-CH_3$ | $-H$ |
| S-97 | $-NH_2$ | $-H$ | 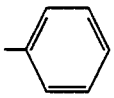 | $-H$ |
| S-98 | $-NH-$ 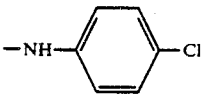 $-Cl$ | $-H$ | $-C_4H_9$ | $-H$ |
| S-99 | $-NHCOCH_3$ | $-CH_3$ | $-CH_3$ | $-H$ |
| S-100 | $-NHCO-$ 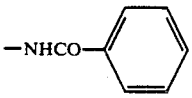 | $-CH_3$ | $-CH_3$ | $-H$ |

-continued

| | | | | |
|---|---|---|---|---|
| S-101 | 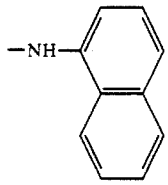 | $-CH_3$ | $-C_3H_7(i)$ | $-H$ |
| S-102 | 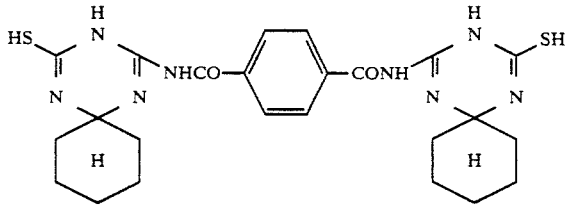 | | | |

The compound represented by the above Formula (S) may include, for example, the compounds disclosed in Japanese Patent Examined Publication No. 28496/1965, Japanese Patent O.P.I. Publication No. 89034/1975, Journal of Chemical Society, 49, 1748 (1927), ditto 4237 (1952), Journal of Organic Chemistry, 39, 2469 (1965), U.S. Pat. No. 2,824,001, Journal of Chemical Society, 1723 (1951), Japanese Patent O.P.I. Publication No. 111846/1981, British Patent No. 1,275,701, U.S. Pat. Nos. 3,266,897 and 2,403,927, etc., which can be synthesized following the procedures also disclosed in these publications.

To incorporate the compound represented by Formula (S) according to this invention (hereinafter "Compound (S)") into the silver halide emulsion layer containing the silver halide grains according to the present invention, it may be dissolved in water or in a freely water-miscible organic solvent (for example, methanol, and ethanol), and then added. The compound (S) may be used alone or in combination with other compounds represented by Formula (S) or any stabilizer or fog restrainer other than the compound represented by Formula (S).

The compound (S) may be added at any time during the period between before the commencement of the step of formation of silver halide grains and on or before the commencement of chemical sensitization. For example, it is added in a mother solution, soluble silver salt solution or soluble halide solution before the formation of grains, or may be added in the course of the formation of grains, after the formation of grains, before the step of desalting or before the step of re-dispersion.

The addition of the compound (S) may be carried out by adding the whole amount thereof in one time, or by dividing it into several times.

There are no particular limitations on the amount for the addition, but the compound may be added usually in the range of from $1\times10^{-6}$ mol to $1\times10^{-1}$ mol, and preferably from $1\times10^{-5}$ mol to $1\times10^{-2}$ mol, per mol of silver halide.

The silver halide grains according to the present invention is chemically sensitized in the presence of an unstable sulfur compound and a gold compound, and the unstable sulfur compound and the gold compound used in the present invention will be described below.

In the present invention, the silver halide grains according to the present invention, containing 90 mol % or more of silver chloride, as exemplified by silver chlorobromide grains, is chemically sensitized using at least a sulfur sensitizer and a gold sensitizer.

Known compounds can be used as the sulfur sensitizer. For example, the sulfur sensitizer that can be used may include thiosulfate, allythiocarbamide, thiourea, allylisothiocyanate, cystine, p-toluene thiosulfonate and rhodanine. Besides these, also usable are the sulfur sensitizers disclosed in U.S. Pat. Nos. 1,574,944, 2,410,689, 2,278,947, 2,728,668, 3,501,313 and 3,656,955, German Laid-open Application (OLS) No. 14 22 869, Japanese Patent O.P.I. Publications No. 24937/1981 and No. 45016/1980, etc.

The sulfur sensitizer may be added in an amount that may sensitize silver halides, and there are no particular limitations of it. As a standard, however, it can contained in an amount of from $1\times10^{-7}$ to $1\times10^{-5}$ mol, and more preferably from $2\times10^{-6}$ to $8\times10^{-6}$ mol per mol of silver halide.

The gold sensitizer that can be used may include the compound wherein the oxidation number of gold is either +1 or +3, and a variety of gold compounds can be used. Typical examples thereof include chloroaurate, potassium chloroaurate, auric trichloride, potassium auric thiocyanate, potassium iodoaurate, tetracyanoauric acid, ammonium aurothiocyanate, and pyridyl trichlorogold.

The gold compound is added in the amount that varies depending on various conditions, but may preferably be added in an amount of from $5\times10^{-7}$ to $5\times10^{-3}$ mol, and preferably from $2\times10^{-6}$ to $1\times10^{-4}$ mol, per mol of silver halide.

The gold compound may be added at any stage during the steps for the preparation of the silver halide emulsion, but may preferably be added in the course after completion of the formation of silver halide and before completion of the chemical sensitization.

In the emulsion of the present invention, the compound (S) may preferably be further added at the time the above chemical sensitization has been completed. Here, it may preferably be added in an amount of from $1\times10^{-6}$ to $1\times10^{-1}$ mol per mol of AgX. At this time, it may also be added simultaneously with the addition of other fogging agents or stabilizers, or as a mixture thereof.

As described above, the silver halide emulsion containing the chloride-rich silver halide grains according to the present invention is subjected to the chemical sensitization in the presence of the unstable sulfur compound and gold compound according to the present invention, and further the chemical sensitization in the presence of the nitro-containing heterocyclic compound according to the present invention. However, to refer only to the latter chemical sensitization, it is described in British Patent No. 1,315,755, and Japanese Patent O.P.I. Publications No. 126526/1983 and No. 232545/1985, etc. However, what are described in the above publications relate to a silver chlorobromide or silver iodobromide having a high silver-bromide content, and, in regard to the effect of the present invention, i.e., the specific effect that can be obtained in the silver halide emulsion having a high silver-chloride content, the effect was quite unexpectable.

It is well known in the present industrial field that the nitrogen-containing heterocyclic compound according to the present invention is used to add it in a silver halide emulsion at the time when chemical ripening of said emulsion has been completed, or at any subsequent stages, for the purpose of preventing the fogging of light-sensitive silver halide photographic materials or improving the stability with time or shelf stability. However, the effect of the present invention can not be obtained if it is added only after completion of the chemical ripening like this, which is outside the present invention.

The silver halide emulsion according to the present invention can be spectrally sensitized to any desired wavelength region, by using dyes known as sensitizing dyes in the photographic industrial field. The sensitizing dyes may be used alone, or in combination of two or more kinds. The emulsion may also contain a dye that has no spectrally sensitizing action by itself together with sensitizing dyes, or a supersensitizing agent, which is a compound not substantially absorbing any visible light and is capable of strengthening the sensitizing action of the sensitizing dyes.

Various ones can be used as the sensitizing dyes, and the respective sensitizing dyes can be used alone or in combination of two or more kinds. The sensitizing dyes that can be advantageously used may include those as set out below.

Namely, sensitizing dyes to be used in a blue-sensitive silver halide emulsion layer may include, for example, those disclosed in West German Patent No. 929,080, U.S. Pat. Nos. 2,231,658, 2,493,748, 2,503,776, 2,519,001, 2,912,329, 3,656,959, 3,672,897, 3,694,217, 4,025,349 and 4,046,572, British Patent No. 1,242,588, Japanese Patent Publications No. 14033/1969 and No. 24844/1977, etc. Sensitizing dyes to be used in a green-sensitive silver halide emulsion may typically include, for example, cyanine dyes, merocyanine dyes or composite cyanine dyes disclosed in U.S. Pat. Nos. 1,939,201, 2,072,908, 2,739,149 and 2,945,763, British Patent No. 505,979, etc. Further, sensitizing dyes to be used in a red-sensitive silver halide emulsion may typically include, for example, cyanine dyes, merocyanine dyes or composite cyanine dyes disclosed in U.S. Pat. Nos. 2,269,234, 2,270,378, 2,442,710, 2,454,629 and 2,776,280, etc. Still further, the cyanine dyes, merocyanine dyes or composite cyanine dyes as disclosed in U.S. Pat. Nos. 2,213,995, 2,493,748 and 2,519,001, West German Patent No. 929,080 can be advantageously used in the green-sensitive silver halide emulsion or the red-sensitive silver halide emulsion.

These sensitizing dyes may be used alone or in combination of any of these. When they are used in combination, they are often used for the purpose of supersensitization. Typical examples thereof are disclosed in U.S. Pat. Nos. 2,688,545, 2,977,229, 3,397,060, 3,522,052, 3,527,641, 3,617,293, 3,628,964, 3,666,480, 3,672,898, 3,679,428, 3,703,377 and 4,026,707, British Patents No. 1,344,281 and No. 1,507,803, Japanese Patent Examined Publications No. 4936/1968 and No. 12375/1978, Japanese Patent O.P.I. Publications No. 110618/1977 and No. 109925/1977.

In instances in which the silver halide emulsion according to the present invention is used as a green-sensitive emulsion, it is preferred to effect spectral sensitization by use of a sensitizing dye represented by Formula (B) shown below.

Formula (B):

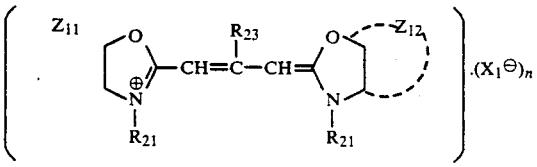

In the formula, $Z_{11}$ and $Z_{12}$ each represent a group of atoms necessary to complete a benzene ring or naphthalene ring condensed to oxazoles. The heterocyclic nucleus thus formed may be substituted with a variety of substituents, and preferable substituents for these are a halogen atom, an aryl group, an alkyl group or an alkoxy group. More preferable substituents are a halogen atom, a phenyl group and a methoxy group, and the most preferable substituent is a phenyl group.

According to a preferred embodiment of the present invention, both of $Z_{11}$ and $Z_{12}$ represent benzene rings condensed to oxazole rings, and at least one benzene ring of these benzene rings is substituted with a phenyl group at the 5-position, or one of the benzene rings is substituted with a phenyl group at the 5-position and the other of the benzene rings, with a halogen atom at the 5-position.

$R_{21}$ and $R_{22}$ each represents an alkyl group, an alkenyl group or an aryl group, and preferably represents an alkyl group. More preferably, $R_{21}$ and $R_{22}$ each are an alkyl group substituted with a carboxyl group or sulfo group, most preferably, a sulfoalkyl group having 1 to 4 carbon atoms. Still most preferably, they each are a sulfoethyl group.

$R_{23}$ represents a hydrogen atom or an alkyl group having 1 to 3 carbon atoms. Preferably, it represents a hydrogen atom or an ethyl group.

$X_1\ominus$ represents an anion, which includes, for example, halogen ions such as chlorine, bromine and iodine, anions such as

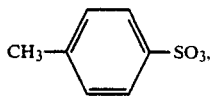

$CH_3SO_4$ and $C_2H_5SO_4$. The symbol n represents 1 or 0. Provided that n represents 0 when the compound forms an intramolecular salt.

Examples of the sensitizing dye represented by Formula (B), preferably used in the present invention, are shown below.

(B-1)
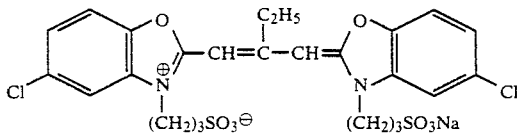
(B-2)
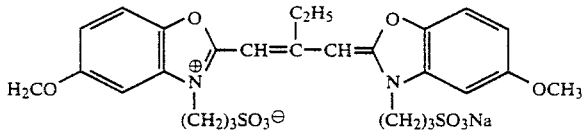
(B-3)
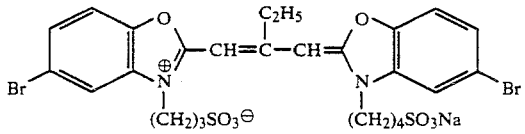
(B-4)
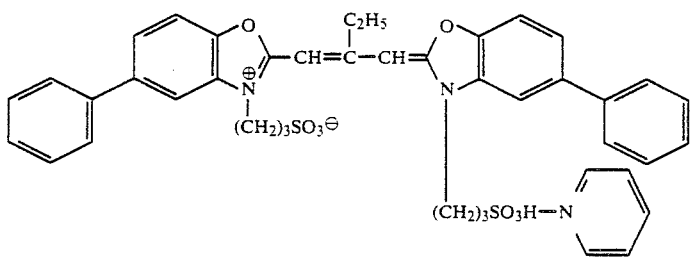
(B-5)
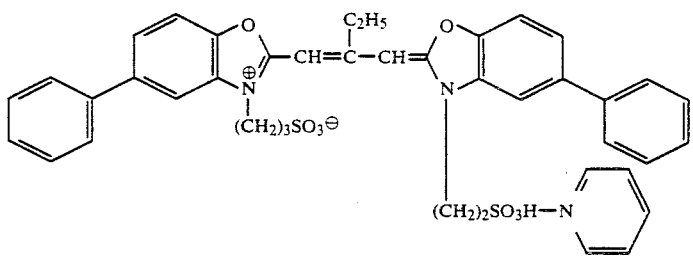
(B-6)
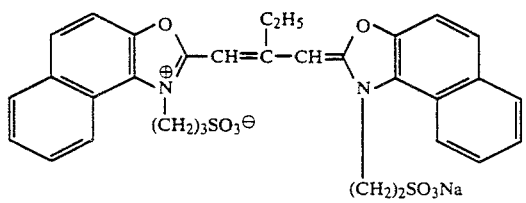
(B-7)
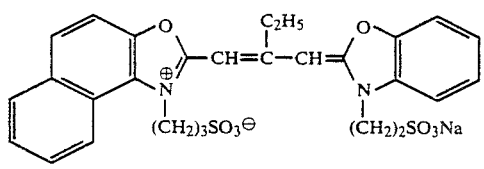
(B-8)
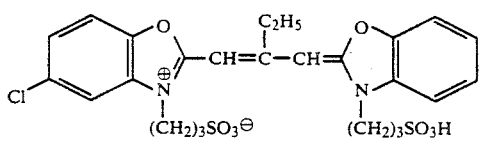

-continued (B-9)

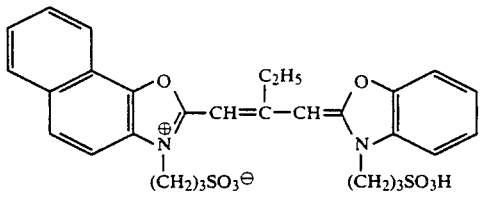

(B-10)

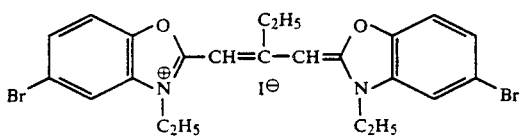

(B-11)

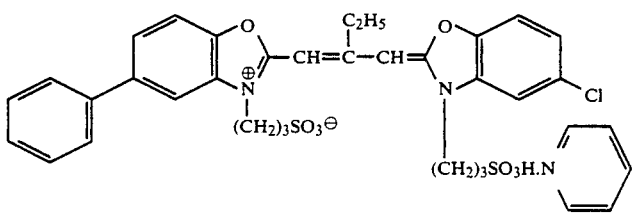

(B-12)

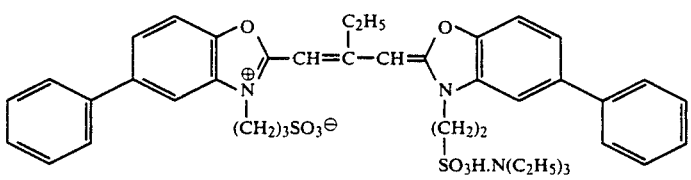

In instances in which the silver halide emulsion according to the present invention is used as a red-sensitive emulsion, it is preferred to effect spectral sensitization by use of a sensitizing dye represented by Formula (C) shown below or a sensitizing dye represented by Formula (D)

Formula (C):

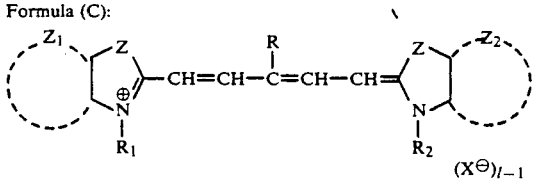

Formula (D):

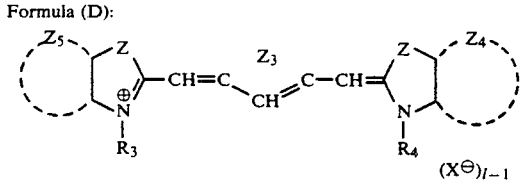

In the formula, R represents a hydrogen atom or an alkyl group; $R_1$ to $R_4$ each represents an alkyl group or an aryl group; $Z_1$, $Z_2$, $Z_4$ and $Z_5$ each represents a group of atoms necessary to complete a benzene ring or naphthalene ring condensed to a thiazole ring or selenazole ring; $Z_3$ represents a group of hydrocarbon atoms necessary to complete a 6-membered ring; L represents 1 or 2; Z represents a sulfur atom or a selenium atom; and $X^{\ominus}$ represents an anion.

In the above formula, the alkyl group represented by R includes a methyl group, an ethyl group and a propyl group, and R is preferably a hydrogen atom, a methyl group or an ethyl group. More preferably, it is a hydrogen atom or an ethyl group.

$R_1$, $R_2$, $R_3$ and $R_4$ each represents a group selected from a linear or branched alkyl group, which alkyl group may have a substituent (for example, methyl, ethyl, propyl, chloroethyl, hydroxyethyl, methoxyethyl, acetoxyethyl, carboxymethyl, carboxyethyl, ethoxycarbonylmethyl, sulfoethyl, sulfopropyl, sulfobutyl, β-hydroxy-γ-sulfopropyl, sulfate propyl, allyl, and benzyl) and an aryl group, which aryl group may have a substituent (for example, phenyl, carboxyphenyl, and sulfophenyl). The heterocyclic ring formed by $Z_1$, $Z_2$, $Z_4$ and $Z_5$ may have a substituent, and preferable substituent is a halogen atom, an aryl group, an alkyl group or an alkoxy group, more preferably, a halogen atom (for example, a chlorine atom), a phenyl group or a methoxy group.

$X^{\ominus}$ represents an anion (for example, Cl, Br, I,

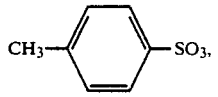

$CH_3SO_4$ and $C_2H_5SO_4$); and L represents 1 or 2.

Provided that L represents 1 when the compound forms an intramolecular salt.

Typical examples of the sensitizing dyes represented respectively by Formulas (C) and (D), preferably used in the present invention, are shown below.

(C-1)
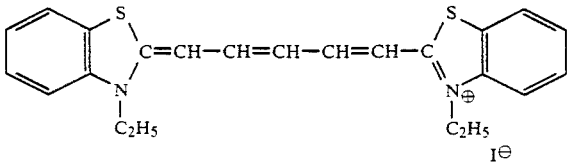
(C-2)
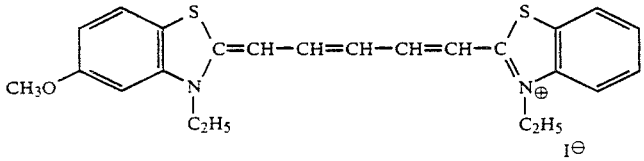
(C-3)
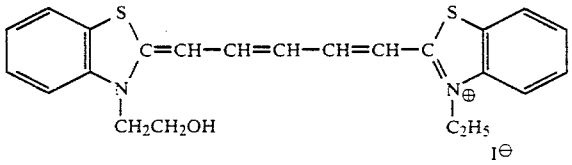
(C-4)
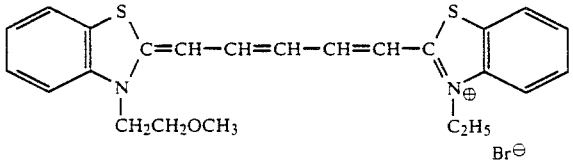
(C-5)
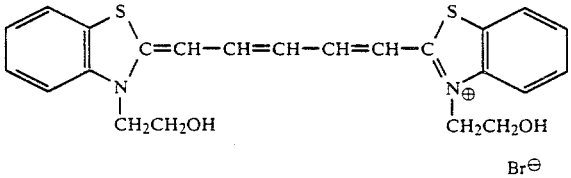
(C-6)
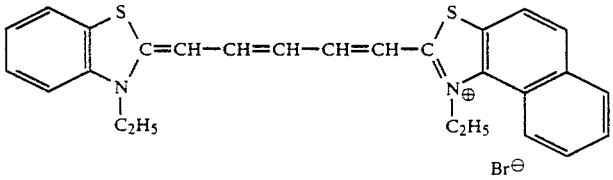
(C-7)
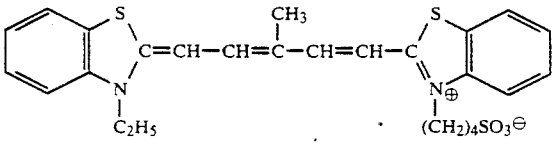
(C-8)
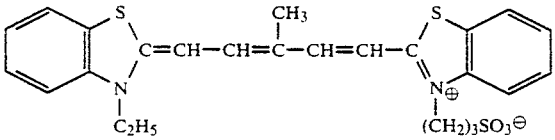

-continued
(C-9)
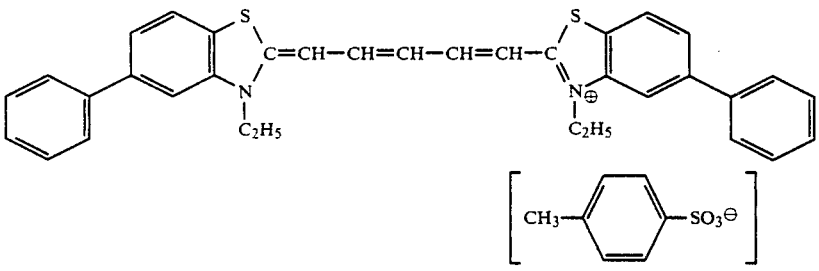
(C-10)
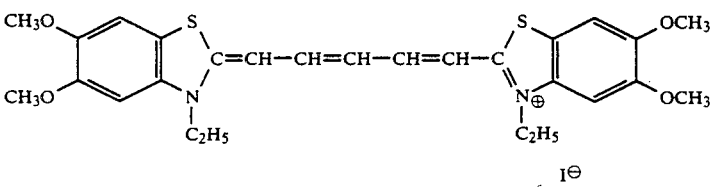
(C-11)
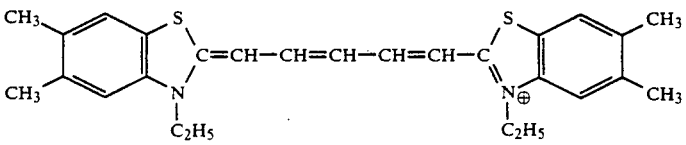
(C-12)
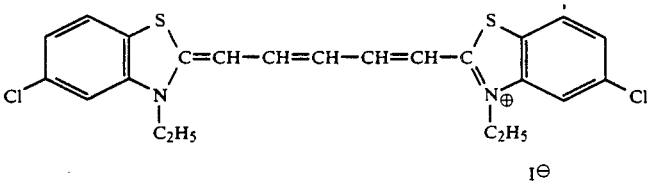
(C-13)
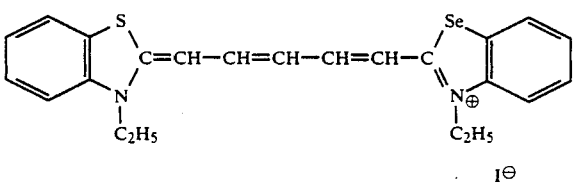
(C-14)
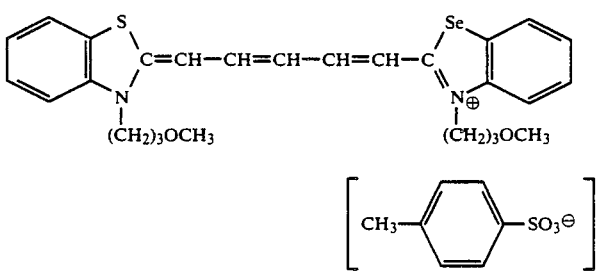
(D-1)
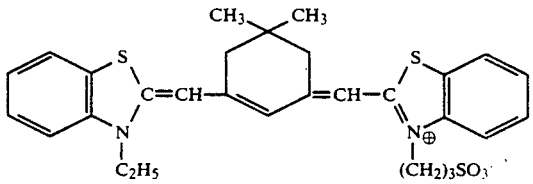
(D-2)
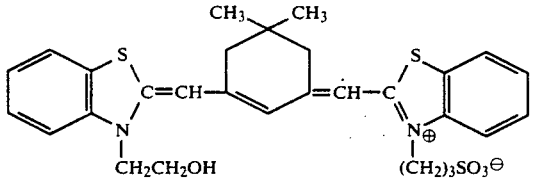

-continued (D-3)

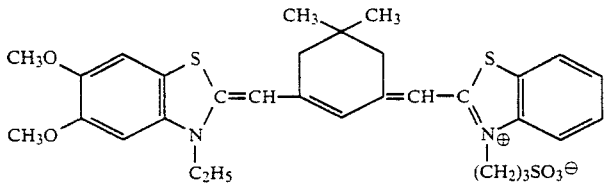

(D-4)

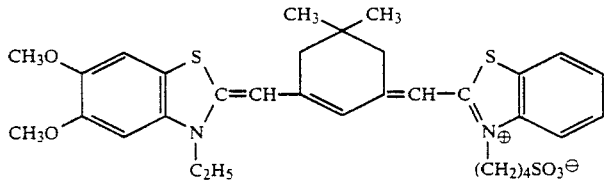

(D-5)

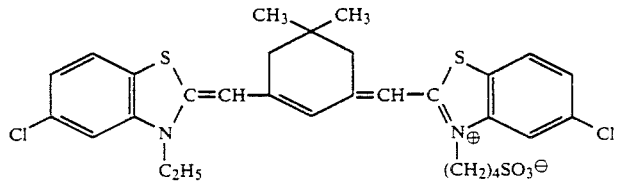

(D-6)

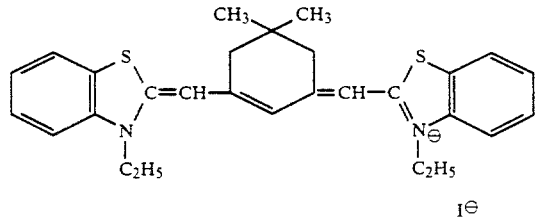

(D-7)

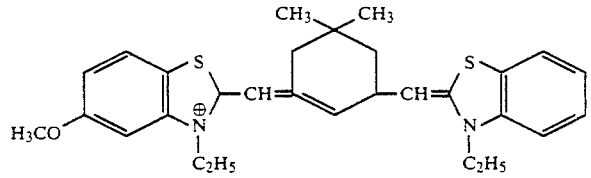

(D-8)

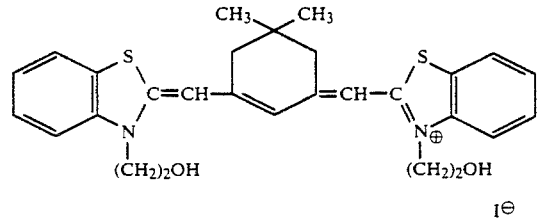

(D-9)

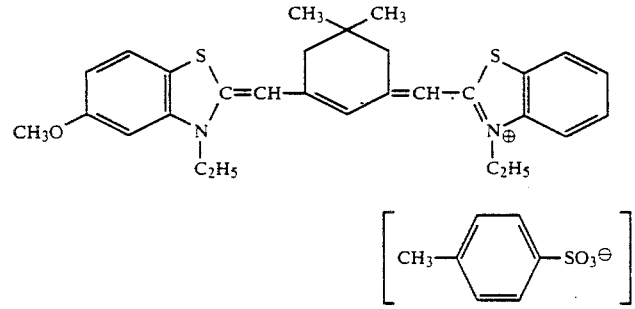

There are no particular limitations on the amount for the addition of the sensitizing dyes, but approximately they may be used preferably in the range of from $1\times10^{-7}$ to $1\times10^{-3}$ mol, and more preferably $5\times10^{-6}$ to $5\times10^{-4}$ mol, per mol of silver halide.

The sensitizing dyes can be added by using the methods well known in the present industrial field.

For example, these sensitizing dyes can be dissolved in a water-soluble solvent such as pyridine, methyl alcohol, ethyl alcohol, methyl cellosolve and acetone (or a mixture of the solvents as above), diluted with water in a certain instance, or dissolved in water in another certain instance, and added in the form of any of these solutions. Also, it is advantageous to use ultrasonic vibration in this dissolution. For the sensitizing dyes used in the present invention, there may be also used a method in which a dye is dissolved in a volatile organic solvent to disperse the resulting solution in hydrophilic colloids, followed by addition of the resulting dispersion, as described in U.S. Pat. No. 3,469,987; and a method in which a water-insoluble dye is dispersed in a water-soluble solvent without dissolution, followed by addition of the resulting dispersion, as described in Japanese Patent Examined Publication No. 24185/1971. Also, the sensitizing dyes used in the present invention can be added in the emulsion in the form of a dispersed product obtained by an acid dissolution dispersion method. As method for such addition, there may be also used the methods described in U.S. Pat. Nos. 2,912,345, 3,342,605, 2,996,287, 3,425,835, etc.

The sensitizing dyes to be contained in the silver halide emulsion of the present invention may be added by dissolving them in solvents of the same or different kind, and then mixing the resulting solutions before addition to the silver halide emulsion, or adding them separately. In the instance in which they are added separately, the order, time and interval therefor can be arbitrarily determined depending on the purpose. The sensitizing dyes used in the present invention may be added in the emulsion at any time during the steps for the preparation of the emulsion, but may preferably be added in the course of the chemical ripening or after the chemical ripening, and may more preferably be added in the course of the chemical ripening.

The light-sensitive silver halide photographic material of the present invention having the above constitution may include, for example, color negative films and color positive films, and color photographic paper, and the effect of the present invention can be effectively exhibited particularly when the color photographic paper used in direct viewing is used.

The light-sensitive silver halide photographic material of the present invention, including this color photographic pater, may be of those for use in monochrome photography or multicolor photography. In the instance of the light-sensitive silver halide photographic material for use in multicolor photography, it usually has the structure that silver halide emulsion layers containing couplers of magenta, yellow and cyan as the photographic couplers and non-sensitive layers are laminated on a support with appropriate layer number and order, but such layer number and order may be appropriately changed depending on what performance is most emphasized and what purpose it is used for.

In instances in which the light-sensitive silver halide photographic material used in the present invention is the multicolor light-sensitive material, the specific layer constitution may particularly preferably be such that a yellow dye image forming later, an intermediate layer, a magenta dye image forming layer, an intermediate layer, a cyan dye image forming layer, an intermediate layer and a protective layer are arranged on a support in succession from the support side.

There are no particular limitations on the dye image forming couplers used in the present invention, and various couplers can be used. They, however, typically include the compounds described in the following patents.

The yellow dye image forming couplers include four equivalent or two equivalent couplers of an acylacetamide type or benzoylmethane type, and these are described, for example, in U.S. Pat. Nos. 2,778,658, 2,875,057, 2,908,573, 3,227,155, 3,227,550, 3,253,924, 3,266,506, 3,277,155, 3,341,331, 3,369,895, 3,384,657, 3,408,194, 3,415,652, 3,447,928, 3,551,155, 3,582,322 and 3,725,072, German Patent No. 15 47 868, No. 20 57 941, No. 21 62 899, No. 21 63 812, No. 22 13 461, No. 22 19 917, No. 22 61 361 and No. 22 63 875, Japanese Patent Publication No. 13576/1974, Japanese Patent O.P.I. Publication No. 29432/1973, No. 66834/1973, No. 10736/1974, No. 122335/1974, No. 28834/1975, No. 132926/1975, No. 144240/1980 and No. 87041/1981.

The magenta dye image forming couplers include four equivalent or two equivalent magenta dye image forming couplers of a 5-pyrazolone type, a pyrazolotriazole type, a pyrazolinobenzimidazole type, an indazolone type or a cyanoacetyl type, and these are described, for example, in U.S. Pat. Nos. 2,600,788, 3,061,432, 3,062,653, 3,127,269, 3,311,476, 3,152,896, 3,419,391, 3,519,429, 3,555,318, 3,684,514, 3,705,896, 3,888,680, 3,907,571, 3,928,044, 3,930,861, 3,930,816 and 3,933,500, Japanese Patent O.P.I. Publication No. 29639/1974, No. 111631/1974, No. 129538/1974, No. 112341/1976, No. 58922/1977, No. 62454/1980, No. 118034/1980, No. 38643/1981, No. 135841/1981, Japanese Patent Examined Publications No. 60479/1971, No. 34937/1977, No. 29421/1980 and No. 35696/1980, British Patent No. 1,247,493, Belgian Patents No. 769,116, West German Patent No. 21 56 111, Japanese Patent Examined Publication No. 60479/1971, Japanese Patent O.P.I. Publications No. 12532/1984, No. 228252/1984, No. 162548/1984, No. 171956/1984, No. 33552/1985 No. 43659/1985, West German Patent No. 10 70 030, and U.S. Pat. No. 3,725,067.

The cyan dye image forming couplers typically include four equivalent or two equivalent cyan dye-forming couplers of phenol type or naphthol type, and these are disclosed in U.S. Pat. Nos. 2,306,410, 2,356,475, 2,362,598, 2,367,531, 2,369,929, 2,423,730, 2,474,293, 2,476,008, 2,498,466, 2,545,687, 2,728,660, 2,772,162, 2,895,826, 2,976,146, 3,002,836, 3,419,390, 3,446,622, 3,476,563, 3,737,316, 3,758,308 and 3,839,044, British Patents No. 478,991, No. 945,542, No. 1,084,480, No. 1,377,233, No. 1,388,024 and No. 1,543,040, Japanese Patent O.P.I. Publication No. 37425/1972, No. 10135/1975, No. 25228/1975, No 112038/1975, No. 117422/1975, No. 130441/1975, No. 6551/1976, No. 37647/1976, No. 52828/1976, No. 108841/1976, No. 109630/1978, No. 48237/1979, No. 66129/1979, No. 131931/1979, No. 32071/1980, No. 146050/1984, No. 31953/1984 and No. 117249/1985.

These dye forming couplers may each desirably have in their molecules a group having 8 or more carbon atoms, called a ballast group and capable of making the couplers non-diffusible. These dye forming couplers may be either of the four equivalent type wherein four silver ions must be reduced for the formation of a dye of one molecule, or of the two equivalent type wherein only two silver ions may be reduced for the same.

In the light-sensitive silver halide photographic material, oil droplets are dispersed in silver halide emulsion layers in which the above silver halide emulsion of the present invention is contained, in an amount not less than twice on the basis of the weight of the silver halide grains contained in said silver halide emulsion.

In the present invention, what is meant by "oil droplets are dispersed in the silver halide emulsion layers" is that oily materials such as high-boiling organic solvents having no miscibility with hydrophilic binders are contained in a dispersed state in the silver halide emulsion layers. Also, the weight of the oil droplets refers to the weight of itself when the high-boiling organic solvents are used alone, and, when any hydrophobic compounds such as couplers, color-turbidity preventive agents, ultraviolet absorbents and image stabilizers are contained in a dissolved state in addition to the high-boiling organic solvents, the weight obtained by totaling all the high-boiling organic solvents and the hydrophobic compounds such as couplers. When the hydrophobic compounds such as ultraviolet absorbents that are oily at room temperature are present as the oil droplets without being dissolved in the high-boiling organic solvents, it further refers to the weight obtained by further adding the weight of these oil droplets to the above weight.

The present invention is applied in the light-sensitive silver halide photographic material in which the weight of the above oil droplets is not less than twice the weight of the silver halide grains contained in the silver halide emulsion in the silver halide emulsion layer containing said oil droplets, but may preferably be applied in the light-sensitive silver halide photographic material in which the weight is not less than three times and not more than 10 times the weight of the above silver halide grains.

In the present invention, there are no particular limitations on the high-boiling organic solvents that form the oil droplets, and any high-boiling organic solvents can be used so long as they can form the oil droplets.

As a binder (or protective colloid) used in the light-sensitive silver halide photographic material of the present invention, it is advantageous to use gelatin, but, besides it, there can be also used hydrophilic colloids such as gelatin derivatives, graft polymers comprising gelatin and other polymer, protein, sugar derivatives, cellulose derivatives, or synthetic hydrophilic polymeric substances including homopolymers and copolymers.

In the light-sensitive silver halide photographic material of the present invention, there can be optionally further used additives such as hardening agents, color-turbidity preventive agents, image stabilizing agents, ultraviolet absorbents, plasticizers, latexes, surface active agents, matting agents, lubricants and antistatic agents.

The light-sensitive silver halide photographic material of the present invention can form images by subjecting it to the color development processing known in the present industrial field.

The color developing agent used in the color developing solution in the present invention includes aminophenol type or p-phenylenediamine type derivatives widely used in the color photographic processes of various types.

In the color developing solution applied in the processing of the light-sensitive silver halide photographic material of the present invention, known compounds for the developing solution components can be added in addition to the above-mentioned primary aromatic amine type color developing agent.

The color developing solution may have the pH of usually 7 or more, and more generally from about 10 to about 13.

The color developing may be carried out at a temperature of not lower than 15° C., and generally at a temperature ranging between 20° to 50° C. It may preferably be carried out at 30° C. or more for the purpose of the rapid development. Conventionally, the development processing is carried out in 3 minutes to 4 minutes. However, in the present invention aiming at the rapid processing, the color development processing may preferably be carried out in the time ranging between 20 seconds and 60 seconds, more preferably ranging between 30 seconds and 50 seconds.

After the color developing, the light-sensitive silver halide photographic material of the present invention is subjected to bleaching and fixing. The bleaching may be carried out at the same time with the fixing.

After the fixing, washing is usually carried out. In substitution for the washing, stabilizing may be carried out, or the both may be used in combination.

As having described in the above, the light-sensitive silver halide photographic material of the present invention achieved a very small illuminance dependence of gradation, and also resulted in very little generation of fog or lowering of density.

EXAMPLES

The present invention will be specifically described below by giving Examples, but the working embodiments are by no means limited to these.

EXAMPLE 1

In the presence of inert gelatin and under conditions of 40° C., pH=2.8 and pAg=7.5, an aqueous solution of silver nitrate and an aqueous halide solution comprised of sodium chloride and potassium bromide were mixed following the double jet method described in Japanese Patent O.P.I. Publication No. 45437/1984, to obtain a monodisperse silver chlorobromide emulsion (EM-1) having a silver chloride content of 99 mol %. Electron-microscopic observation on EM-1 revealed that it comprised grains having a cubic form and an average grain size of 0.42 μm.

Next, prepared were an emulsion (EM-2) obtained by adding, when 50% of the aqueous silver nitrate solution was added, $5\times10^{-6}$ mol of potassium hexachloroiridate (IV) per mol of silver halide under entirely the same conditions as EM-1; an emulsion (EM-3) obtained by adding $10^{-4}$ mol of Compound S-42 per mol of silver halide in the aqueous halide solution under the same conditions as EM-1; and an emulsion (EM-4) obtained by adding potassium hexachloroiridate (IV) as in EM-2 and Compound S-42 as in EM-3, under the same conditions as EM-1. The resulting emulsions each had an average grain size of 0.42 μm, 0.43 μm and 0.42 μm, respectively.

Next, sodium thiosulfate and chloroauric acid were added to EM-1, EM-2, EM-3 and EM-4, and spectral sensitization was further carried out using red-sensitive sensitizing dye D-7. At the time of completion of chemical ripening, $10^{31\ 2}$ mol of mercapto compound S-1 of the present invention, per mol of silver halide, was added as a stabilizing agent to prepare emulsions EMR-1 to EMR-4 as shown in Table 1.

EMR-5 and EMR-6 were also prepared in the same manner as in EMR-4 but replacing the sensitizing dye with DC-1 or DD-1.

TABLE 1

| Red-sensitive emulsion No. | Emulsion No. (before chemical ripening) | Amount of iridium compound *1 added (mol/mol AgX) | Amount of nitrogen-containing heterocyclic compound (mol/mol AgX) (Chemical ripening) |
|---|---|---|---|
| EMR-1 | EM-1 | — | — |
| 2 | 2 | $5 \times 10^{-6}$ | — |
| 3 | 3 | — | $1 \times 10^{-4}$ |
| 4 | 4 | $5 \times 10^{-6}$ | $1 \times 10^{-4}$ |
| 5 | 4 | $5 \times 10^{-6}$ | $1 \times 10^{-4}$ |
| 6 | 4 | $5 \times 10^{-6}$ | $1 \times 10^{-4}$ |

*1 $K_2IrCl_6$

DC-1

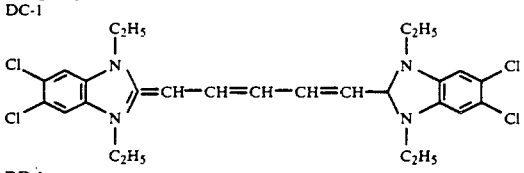

DD-1

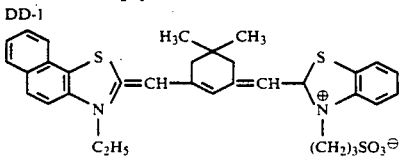

Next, using EMR-1 to EMR-6 as red-sensitive emulsions, light-sensitive silver halide photographic materials constituted as follows were prepared, which were designated as Sample 1 to Sample 8.

Protective layer:
- Gelatin
- Hardening agent

Emulsion layer:
- Red-sensitive emulsion
- Cyan coupler CC-1
- High-boiling organic solvent
- Gelatin Support: Polyethylene-coated paper

CC-1

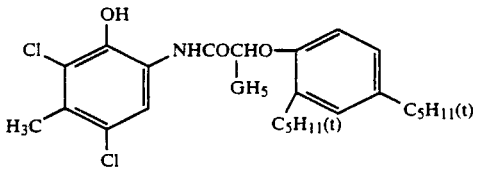

Next, using the above samples, tests were carried out in the following manner to examine the illuminance dependence of gradation.

Each sample was subjected to wedge exposure in an exposure time of 0.05 second (high illuminance) and in an exposure time of 10 seconds (low illuminance) with the same amount of exposure, followed by color development processing as shown below, and then sensitometry was carried out on the resulting sample to examine the gradation variation ($\Delta\bar{\gamma}$).

| [Processing steps] | Temperature | Time |
|---|---|---|
| Color developing | 35.0 ± 0.3° C. | 45 seconds |
| Bleach-fixing | 35.0 ± 0.3° C. | 45 seconds |
| Stabilizing | 30 to 34° C. | 90 seconds |
| Drying | 60 to 80° C. | 60 seconds |

[Color developing solution]

| | |
|---|---|
| Pure water | 800 ml |
| Triethanolamine | 10 g |
| N,N-diethylhydroxylamine | 5 g |
| Potassium bromide | 0.02 g |

-continued

| | |
|---|---|
| Potassium chloride | 2 g |
| Potassium sulfite | 0.3 g |
| 1-Hydroxyethylidene-1,1-diphosphonate | 1.0 g |
| Ethylenediaminetetraacetic acid | 1.0 g |
| Disodium catechol-3,5-disulfonate | 1.0 g |
| N-ethyl-N-β-methanesulfonamidoethyl-3-methyl-4-aminoaniline sulfate | 4.5 g |
| Brightening agent (a 4,4'-diaminostilbenedisulfonic acid derivative) | 1.0 g |
| Potassium carbonate | 27 g |
| Made up to 1 l in total amount by adding water, and adjusted to pH = 10.10 | |
| [Bleach-fixing solution] | |
| Ferric ammonium ethylenediaminetetraacetate dihydrate | 60 g |
| Ethylenediaminetetraacetic acid | 3 g |
| Ammonium thiosulfate (an aqueous 70% solution) | 100 ml |
| Ammonium sulfite (an aqueous 40% solution) | 27.5 ml |
| Made up to 1 l by adding water, and adjusted to pH = 6.2 using potassium carbonate or glacial acetic acid. | |
| [Stabilizing solution] | |
| 5-Chloro-2-methyl-4-isothiazolin-3-on | 1.0 g |
| Ethylene glycol | 1.0 g |
| 1-Hydroxyethylidene-1,1-diphosphonate | 2.0 g |
| Ethylenediaminetetraacetic acid | 1.0 g |
| Ammonium hydroxide (an aqueous 20% solution) | 3.0 g |
| Ammonium sulfite | 3.0 g |
| Brightening agent (a 4,4'-diaminostilbenedisulfonic acid derivative) | 1.5 g |
| Made up to 1 l by adding water, and adjusted to pH = 7.0 using sulfuric acid or potassium hydroxide. | |

Results obtained are shown in Table 2. Here, $\bar{\gamma}$ indicates a value to represent the gradation, and $\Delta\gamma$ indicates the difference between the $\bar{\gamma}$ obtained when the exposure was effected under the high illuminance and the $\bar{\gamma}$ obtained when the exposure was effected under the low illuminance. The smaller this value is, the smaller the illuminance dependence of gradation is, to give a superior light-sensitive material.

Next, using the above samples, tests were carried out to examine the pressure resistance in a dried state.

(1) Pressure resistance in a dried state (Pressure before exposure)

Samples were left to stand for 2 hours or more at 25° C. and a relative humidity of 40%. Thereafter a ball-point needle of 0.1 mm in ball diameter was stood on the surface of each sample, and, while the sample surface was moved in parallel at a rate of 1 cm/sec, a load continuously varying from 0 to 100 g was simultaneously applied to the ball-point needle. Thereafter, uniform exposure was effected so as to give a color density of from 0.1 to 0.3 after development processing, followed by the same development processing (color developing: 40 seconds) as in the above sensitometry evaluation. The resulting samples were visually observed to evaluate the degree of the decrease in density and increase in density owing to the pressure. Criterions for the evaluation are as follows:

A: Excellent, with little change in density.

B: A small change in density can be seen.

C: A great change in density is seen, raising a problem from a practical view point.

(2) Pressure resistance in a dried state (pressure after exposure)

Evaluated in the same manner as in the pressure before exposure in the above (1) except that the exposure is effected before the application of pressure.

Result obtained in the above are shown together in Table 2.

TABLE 2

| Sample No. | Starting emulsion | Amount of oil-droplet-forming hydrophobic compound (wt %/AgX) | Gradation variation ($\Delta\bar{\gamma}$) | Dried-state pressure resistance: Pressure before exposure | Dried-state pressure resistance: Pressure after exposure |
|---|---|---|---|---|---|
| 1 (X) | EMR-1 | 300 | 0.63 | B | B |
| 2 (X) | EMR-2 | 300 | 0.52 | C | BC |
| 3 (X) | EMR-3 | 300 | 0.58 | B | AB |
| 4 (Y) | EMR-4 | 300 | 0.27 | A | AB |
| 5 (Y) | EMR-4 | 250 | 0.31 | A | AB |
| 6 (Y) | EMR-4 | 150 | 0.38 | B | B |
| 7 (Y) | EMR-4 | 300 | 0.32 | A | B |
| 8 (Y) | EMR-4 | 300 | 0.34 | B | AB |

pressure resistance. In particular, Sample 4, in which the oil-droplet-forming hydrophobic compound is used in an amount of 200% or more, shows a particularly small gradation variation and also having a superior pressure resistance.

Samples 7 and 8 are different from Sample 4 only in the sensitizing dye, but tend to be slightly poor in both the gradation variation $\Delta\bar{\gamma}$ and dried-state pressure resistance. It is therefore seen that the sensitizing dye also correlates to the above properties.

EXAMPLE 2

Basically following the procedures in Example 1, the following emulsions were prepared.

X: Control; Y: Present invention

| Emulsion No. | pH in grain formation | Silver chloride content (mol %) | Nitrogen-containing heterocyclic compound: Type | Nitrogen-containing heterocyclic compound: Amount (mol/mol AgX) | Nitrogen-containing heterocyclic compound: Position of addition | Iridium compound*: Amount (mol/mol AgX) | Iridium compound*: Position of addition | Grain size (μm) | Variation coefficient |
|---|---|---|---|---|---|---|---|---|---|
| EM-6 (Y) | 2.8 | 99.5 | S-42 | $0.5 \times 10^{-4}$ | In halide solution | $5 \times 10^{-7}$ | At 50% addition of total silver weight | 0.71 | 0.11 |
| 7 (X) | 2.8 | 99.0 | — | — | — | — | — | 0.36 | 0.18 |
| 8 (X) | 7.5 | 99.0 | S-42 | $0.8 \times 10^{-4}$ | In halide solution | $2 \times 10^{-6}$ | At 50% addition of total silver weight | 0.35 | 0.14 |
| 9 (X) | 2.8 | 99.0 | — | — | — | $2 \times 10^{-6}$ | At 50% addition of total silver weight | 0.36 | 0.13 |
| 10 (X) | 2.8 | 95.0 | S-42 | $0.8 \times 10^{-4}$ | In halide solution | — | — | 0.36 | 0.13 |
| 11 (X) | 2.8 | 80.0 | S-42 | $0.8 \times 10^{-4}$ | " | $2 \times 10^{-6}$ | At 50% addition of total silver weight | 0.35 | 0.15 |
| 12 (Y) | 2.8 | 99.0 | S-42 | $1.3 \times 10^{-4}$ | " | $2 \times 10^{-6}$ | At 50% addition of total silver weight | 0.41 | 0.11 |
| 13 (Y) | 4.0 | 99.0 | S-42 | $1.0 \times 10^{-5}$ | At completion of addition of Ag and halide | $2 \times 10^{-6}$ | At 50% addition of total silver weight | 0.40 | 0.14 |
| 14 (Y) | 2.8 | 99.0 | S-42 | $0.8 \times 10^{-4}$ | In halide solution | $2 \times 10^{-6}$ | At 50% addition of total silver weight | 0.35 | 0.14 |
| 15 (Y) | 2.8 | 99.0 | S-16 | $0.8 \times 10^{-4}$ | " | $2 \times 10^{-6}$ | In halide solution | 0.34 | 0.12 |
| 16 (Y) | 5.6 | 99.0 | S-42 | $1.0 \times 10^{-4}$ | " | $2 \times 10^{-6}$ | At 50% addition of total silver weight | 0.33 | 0.16 |
| 17 (Y) | 2.8 | 99.0 | S-36 | $0.8 \times 10^{-4}$ | " | $2 \times 10^{-6}$ | In halide solution | 0.35 | 0.10 |
| 18 (Y) | 2.8 | 99.0 | S-45 | $0.8 \times 10^{-4}$ | Before addition, in mother solution | $1.6 \times 10^{-6}$ | At 50% addition of total silver weight | 0.34 | 0.15 |

*$K_2IrCl_2$

S-16

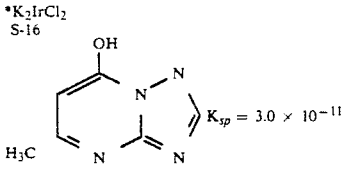

S-36

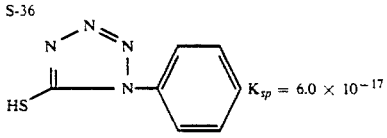

S-45

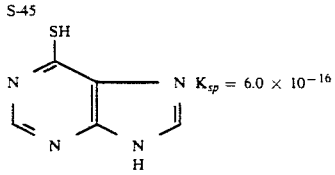

X: Control
Y: Present invention

As will be seen from the above results, Sample 2, in which only the iridium compound was added, has a poor pressure resistance, and Sample 3, in which the nitrogen-containing heterocyclic compound only was added, has a large gradation variation $\Delta\bar{\gamma}$. On the other hand, Samples 4 to 6 of the present invention show a small gradation variation $\Delta\bar{\gamma}$ and a superior dried-state Next, sodium thiosulfate and chloroauric acid were added to EM-6 to EM-18 to effect chemical sensitization, and Compound S-42 of the present invention was added at the time the chemical sensitization was completed. A blue-sensitive sensitizing dye was added to EM-6 to make blue-sensitive emulsion EMB-6, and a green-sensitive sensitizing dye was added to each of EM-7 to EM-18 to obtain EMG-7 to EMG-20. Here, EMG-7 to EMG-18 were prepared by adding the exemplary sensitizing dye B-12 to each of EM-7 to EM-18, and EMG-19 and EMG-20 were prepared by replacing the dye EMG-14 with DB-1 and DB-2, respectively.

DB-1

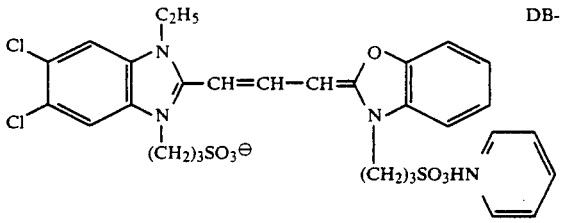

DB-2

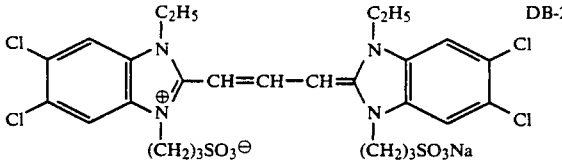

Using the above emulsion and with other constitution as shown in Table 4, the respectively corresponding light-sensitive materials (Samples 107 to 115) were prepared.

TABLE 4

| Layer | Constitution |
|---|---|
| 7th layer | Gelatin (1.0 g/m$^2$) |
| 6th layer | Ultraviolet absorbent (UV-1, 0.3 g/m$^2$)<br>Gelatin (0.7 g/m$^2$) |
| 5th layer | Red-sensitive emulsion EMR-4<br>(Coated silver weight: 0.20 g/m$^2$)<br>Cyan coupler CC-2 (0.40 g/m$^2$)<br>Dibutyl phthalate (0.2 g/m$^2$)<br>Gelatin (1.0 g/m$^2$) |
| 4th layer | Ultraviolet absorbent (UV-1, 0.7 g/m$^2$)<br>Gelatin (1.3 g/m$^2$) |
| 3rd layer | Green-sensitive silver chlorobromide emulsion<br>EMG-7 to EMG-20 (Coated silver weight: 0.20 g/m$^2$)<br>Magenta coupler MC-1 (0.4 g/m$^2$)<br>Dibutyl phthalate (0.2 g/m$^2$)<br>Gelatin (1.5 g/m$^2$) |
| 2nd layer | Gelatin (1.0 g/m$^2$)<br>HQ-1 (0.1 g/m$^2$) |
| 1st layer | Blue-sensitive silver chlorobromide emulsion<br>EMB-6 (Coated silver weight: 0.35 g/m$^2$)<br>Yellow coupler YC-1 (0.9 g/m$^2$)<br>Dibutyl phthalate (0.03 g/m$^2$)<br>Gelatin (2.0 g/m$^2$) |
| Support | Polyethylene-coated paper |

YC-1

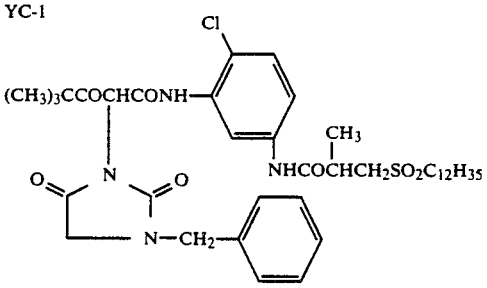

TABLE 4-continued

Magenta Coupler (MC-1)

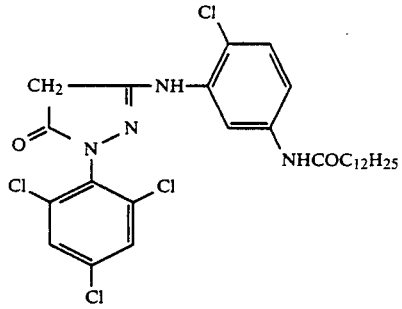

CC-2

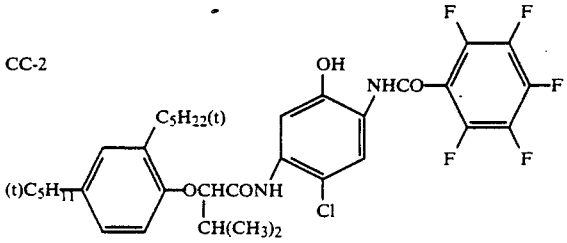

Ultraviolet absorbent UV-1

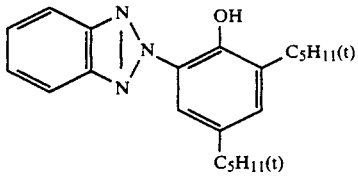

HQ-1

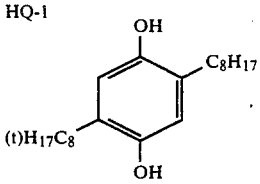

Next, Samples 107 to 120 were processed in the same manner as in Example 1, and, in respect of their green-sensitive emulsion layers, sensitometry was carried out and the gradation variation by exposure illuminance was examined. The dried-state pressure resistance was also examined. Results obtained are shown in Table 5.

Also, in regard to the speed, it is indicated as a reciprocal of the amount of exposure necessary to obtain a reflection density of 0.8, and evaluated as a relative value thereof.

TABLE 5

| Sample No. | Green-sensitive layer emulsion No. | Sensitometry Relative speed | Sensitometry Dmin | Gradation variation $\Delta\bar{\gamma}$ | Dried-state pressure resistance: Pressure before exposure | Dried-state pressure resistance: Pressure after exposure |
|---|---|---|---|---|---|---|
| 107 | EMG-7 (X) | 100 | 0.06 | 0.52 | B | BC |
| 108 | EMG-8 (X) | 98 | 0.05 | 0.29 | BC | B |

TABLE 5-continued

| Sample No. | Green-sensitive layer emulsion No. | Sensitometry Relative speed | Sensitometry Dmin | Gradation variation $\Delta\gamma$ | Dried-state pressure resistance: Pressure before exposure | Dried-state pressure resistance: Pressure after exposure |
|---|---|---|---|---|---|---|
| 109 | EMG-9 (X) | 97 | 0.05 | 0.33 | B | BC |
| 110 | EMG-10 (X) | 101 | 0.04 | 0.44 | B | BC |
| 111 | EMG-11 (X) | 72 | 0.03 | 0.30 | B | B |
| 112 | EMG-12 (Y) | 98 | 0.03 | 0.25 | B | B |
| 113 | EMG-13 (Y) | 98 | 0.04 | 0.20 | B | AB |
| 114 | EMG-14 (Y) | 99 | 0.04 | 0.22 | A | AB |
| 115 | EMG-15 (Y) | 100 | 0.03 | 0.19 | B | B |
| 116 | EMG-16 (Y) | 101 | 0.04 | 0.25 | B | AB |
| 117 | EMG-17 (Y) | 104 | 0.03 | 0.21 | AB | A |
| 118 | EMG-18 (Y) | 97 | 0.04 | 0.22 | B | AB |
| 119 | EMG-19 (Y) | 97 | 0.04 | 0.25 | B | B |
| 120 | EMG-20 (Y) | 98 | 0.04 | 0.27 | B | AB |

X: Control
Y: Present invention

It is seen from the above results that EMG-8 (Sample 108), in which the pH at the formation of grains is 7.5 (outside the present invention), EMG-9 (Sample 109), in which no nitrogen-containing heterocyclic compound is contained (outside the present invention), EMG-10 (Sample 110), in which no iridium compound is contained (outside the present invention), and EMG-11 (Sample 111), in which the silver chloride content is 70 mol % (outside the present invention) are all can not satisfy both the gradation variation by exposure illuminance and dried-state pressure resistance. On the other hand, EMG-12 to EMG-18 are all seen to show a small gradation variation by exposure illuminance and to be superior in the dried-state pressure resistance. In addition, among these, EMG-14 (Sample 114), EMG-117 (Sample 117) and EMG-18 (Sample 118), in which, in particular, the $K_{SP}$ of the nitrogen-containing heterocyclic compound is $10^{-12}$ or less, the grain size ranges between 0.2 μm and 1.6 μm and the variation coefficient is 0.22 or less, show a small gradation variation by exposure illuminance and also a superior dried-state pressure resistance.

Also, Samples 119 and 120, in which only the sensitizing dye was changed with respect to EMG-14, show a slightly poor gradation variation $\Delta\bar{\gamma}$ and dried-state pressure resistance, and it is therefore seen that in the present invention the effect thereof can be strongly exhibited by using the dye as represented by Formula (B).

What is claimed is:

1. A light-sensitive silver halide photographic material comprising a support having thereon a silver halide emulsion layer containing silver halide grains with a silver chloride content of not less than 90 mole percent, wherein (a) formation of said silver halide grains occurs under a pH of not more than 5, (b) an iridium compound is added before physical ripening is begun, and (c) a nitrogen-containing heterocyclic compound represented by Formula S is added at, or before, the completion of an addition of either solution used for the formation of said silver halide grains, with the proviso that a solubility product of said compound with a silver ion is not more than $10^{-12}$,

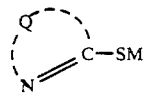

formula S wherein Q represents a group of atoms necessary to for a 5-member or 6-member heterocyclic group, or a 5-member or 6-member heterocyclic group fused with a benzene ring; and M represents a hydrogen atom or a cation.

2. The light-sensitive silver halide photographic material of claim 1, wherein the grain size of said silver halide grain is 0.2 μm to 1.6 μm.

3. The light-sensitive silver halide photographic material of claim 1, wherein the variation coefficient of said silver halide grains is not more than 0.22.

4. The light-sensitive silver halide photographic material of claim 1, wherein said silver halide emulsion layer contains oil particles at an amount not less than twice as much as that of silver halide.

5. The light-sensitive silver halide photographic material of claim 1, wherein said silver chloride content is 99.0 mol % to 99.9 mol %.

6. The light-sensitive silver halide photographic material of claim 1, wherein said silver halide is silver bromide.

7. The light-sensitive silver halide photographic material of claim 1, wherein the amount of said iridium compound is $10^{-8}$ mol to $10^{-4}$ mol per 1 mol of silver halide.

8. The light-sensitive silver halide photographic material of claim 7, wherein the amount is $10^{-5}$ mol to $10^{-2}$ mol per 1 mol of silver halide.

9. The light-sensitive silver halide photographic material of claim 1, wherein the compound represented by formula [S] is selected from those represented by formulas [SA], [SB], [SC] and [SD] below;

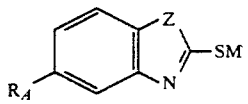

[SA]

wherein $R_A$ is selected from a hydrogen atom, an alkyl group, an alkoxy group, an aryl group, a halogen atom, a carboxyl group or a salt thereof, a sulfo group or a salt thereof and an amino group; Z is an imino group, an oxygen atom or a sulfur atom; and M is a hydrogen atom or a cation;

[SB]

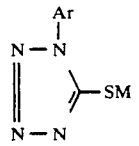

wherein Ar is selected from the group consisting of

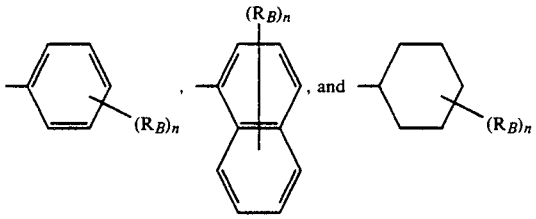

$R_B$ is selected from an alkyl group, an alkoxy group, a carboxyl group or a salt thereof, a sulfo group or a salt thereof, a hydroxyl group, an amino group, an acylamino group, a carbamoyl group and a sulfonamido group; n is an integer of 0, 1 or 2; and M is a hydrogen atom or a cation;

[SC]

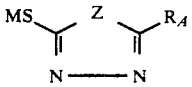

wherein Z is an oxygen atom, a sulfur atom or a

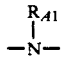

group;

$R_A$ is selected from a hydrogen atom, an alkyl group, an aryl group, an alkenyl group, a cycloalkyl group, a $-SR_{A1}$ group, an

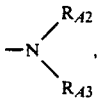

a $-NHCOR_{A4}$ group, a $-NHSO_2R_{A5}$ group and a heterocyclic group, in which $R_{A1}$ is selected from a hydrogen atom, an alkyl group, an alkenyl group, a cycloalkyl group, an aryl group, a $-COR_{A4}$ group and a $-SO_2R_{A5}$ group, $R_{A2}$ and $R_{A3}$ are independently selected from a hydrogen atom, an alkyl group and an aryl group, $R_{A4}$ and $R_{A5}$ are independently selected from an alkyl group and an aryl group, and M is a hydrogen atom or a cation;

[SD]

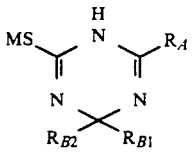

wherein $R_A$ and M are respectively the same atom or group as $R_A$ and M in formula [SC], and $R_{B1}$ and $R_{B2}$ respectively represent the same atom or group as $R_{A1}$ and $R_{A2}$ in formula [SC].

* * * * *